United States Patent [19]

Hufgard

[11] Patent Number: 4,905,905

[45] Date of Patent: Mar. 6, 1990

[54] PAINT SPRAY NOZZLE

[75] Inventor: John W. Hufgard, Novelty, Ohio

[73] Assignee: AccuSpray, Inc., Cleveland, Ohio

[21] Appl. No.: 101,563

[22] Filed: Sep. 28, 1987

[51] Int. Cl.[4] ..... B05B 1/28

[52] U.S. Cl. ..... 239/301; 239/297

[58] Field of Search ..... 239/296, 297, 300, 301, 239/407, 434.5

[56] References Cited

U.S. PATENT DOCUMENTS

| | | | |
|---|---|---|---|
| 1,608,833 | 11/1926 | Birkenmaier et al. | 239/297 |
| 1,906,975 | 5/1933 | Larson | 239/297 |
| 2,602,004 | 7/1952 | Faktor | 239/301 |
| 2,740,670 | 4/1956 | Harder | 239/297 |
| 4,221,339 | 9/1980 | Yoshikawa | 239/704 |
| 4,744,518 | 5/1988 | Toth | 239/297 |

FOREIGN PATENT DOCUMENTS

| | | | |
|---|---|---|---|
| 222966 | 7/1959 | Australia . | |
| 496231 | 11/1938 | United Kingdom | 239/553 |
| 736131 | 8/1955 | United Kingdom | 239/296 |

*Primary Examiner*—Andres Kashnikow
*Assistant Examiner*—Christopher G. Trainor
*Attorney, Agent, or Firm*—Sidney W. Millard

[57] ABSTRACT

An improved spray nozzle for use with air atomizable liquids wherein the spray pattern created by the atomizing nozzle may be adjusted from a circular pattern to a flat pattern or alternatively to an open oval, the open end facing in preselected directions, the adjustments being capable of occuring during the continuous operation of the nozzle. A pattern adjusting plate may be movably aligned with the pattern adjusting nozzles thereby creating the appropriate combination of pattern adjusting nozzles to create the desired pattern.

11 Claims, 1 Drawing Sheet

PAINT SPRAY NOZZLE

FIELD OF THE INVENTION

The invention relates to an improved paint spray nozzle for adjusting the spray pattern.

BACKGROUND OF THE INVENTION

Spray nozzles, especially those used with spray painting systems, atomize the liquid paint by means of atomizing air which enters the nozzle via a chamber which surrounds a fluid nozzle. The atomizing air is then impinged on the end of the chamber and exits via a central aperture located at the end of the chamber. The paint is atomized by the violent forward motion of this air as it exits the nozzle via the aperture. The initial conventional pattern of the atomized liquid and air mixture is a circle because the exit aperture is circular.

The term pattern is defined as and used herein to describe a cross section of the atomized liquid cloud in a plane perpendicular to the direction of the spray of the fluid nozzle. When the compressed air source for a spray painting apparatus utilizes a high volume, low pressure compressor, it is conventional for the nozzle on the spray painting gun to have a central aperture which is considerably larger than the fluid nozzle. Therefore, the large amount of air utilized in a conventional nozzle is due to the relative size of the central aperture to that of the fluid nozzle. This excess air, air beyond that required to atomize the liquid properly, constitutes an energy waste as well as a pollution problem. The air is a pollution problem since the air in a paint system will tend to carry the paint solvent and the more air that is used the more dilute the solvent and the more air that must be processed for the removal of solvents utilizing extremely difficult low concentration removal techniques.

Therefore, there is a need for an improved spray nozzle which utilizes less air, and more efficiently utilizes the air that it actually uses.

The pattern of a spray nozzle is conventionally adjusted by impinging additional air jets into the original circular pattern at a location beyond the outlet aperture. Standardly two oppositely directed jets produce a flat or oval pattern, and if those jets are very powerful it produces a flat fan type spray pattern which is many times wider than it is high. However, in production line spraying, there are needs for other than such a flat or oval pattern, especially when spray painting the reverse sides of objects or spray painting in an out-of-position way and also the traditional problem of painting the insides of angular surfaces.

Therefore, there is also a need for improved pattern control in spray nozzle systems and the ability to adjust the pattern to other than a flat or oval pattern. It would additionally be desirable if such adjustments or modifications of the pattern could be achieved without the necessity of changing the nozzle in use.

SUMMARY OF THE INVENTION

An improved spray nozzle according to this invention includes an atomizing chamber with a central aperture for the exit of atomized liquid spray. The chamber has a converging frusto-conical surface approaching the aperture that acts to direct and streamline the atomizing air.

A fluid nozzle is mounted concentrically with the aperture and the exterior surface is fluted to further direct atomizing air through the aperture in streamline flow as opposed to turbulent flow.

Another aspect of the present invention is a pattern adjusting plate which adjusts the air flow to the pattern adjusting nozzles which can be directed at the atomized liquid spray.

BRIEF DESCRIPTION OF THE DRAWINGS

The best mode contemplated in carrying out this invention is illustrated in the accompanyng drawings in which.

DESCRIPTION OF THE PREFERRED EMBODIMENT

Figure 1:
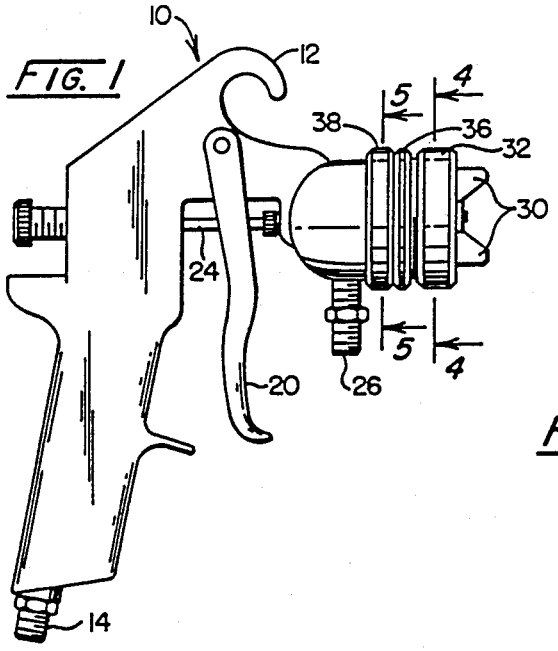
FIG. 1 is an elevational view of a paint spray assembly utilizing a nozzle according to the present invention.

With reference to the drawings, FIG. 1 shows a paint spray gun which utilizes a nozzle according to the present invention. Any conventional spray painting gun has a pistol type grip handle on a body 10 and can optionally have a hook assembly 12 for hanging the gun after work has been completed or for temporary storage.

An air supply fitting 14 provides a source of low pressure constant volume compressed air to the spray painting assembly. Within the body of the spray gun 10 the air supply is directed along a path to an air chamber adjacent a paint nozzle as will be explained subsequently.

The paint gun body 10 also has a trigger assembly 20 which is held in its closed position by a spring (not shown) in the body of the base of the handle. Additionally a pull rod 24 is moved by the trigger assembly, pull rod 24 serving to adjust the flow rate of paint to the nozzle tip while paint supply fitting 26 provides direct access to the supply paint.

Figure 2:
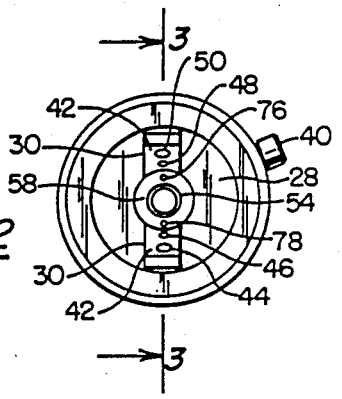
FIG. 2 is an end view of the nozzle of FIG. 1.

On the forward end of the body 10 is a nozzle or air cap 28 having a pair of forwardly projecting ears 30, best seen in FIG. 2. The cap 28 is mounted in operatiave position on body 10 and secured in place by a collar 32 threadedly engaging external threads 34 on the body. Also threaded on threads 34 is a lock ring 36. The purpose of lock ring 36 is to lock annular air adjusting ring 38 in place during operation. An adjusting lever 40 is threaded into the adjusting ring 38 and allows adjustment of the spray pattern as will be explained subsequently.

Turning now to FIG. 2 which is an end view of the nozzle assembly looking from the end upon which the nozzle ears 30 are provided. Within the concave nozzle ear faces 42 are pattern adjusting orifices 44, 46, 48, 50 in fluid communication with an air chamber 52. Additionally shown in the end view of the nozzle assembly is fluid nozzle valve 54 and fluid stop pin 56. Fluid stop pin 56 is the extension of pull rod 24 which is adjusted by means of the spring loaded trigger 20.

Figure 3:
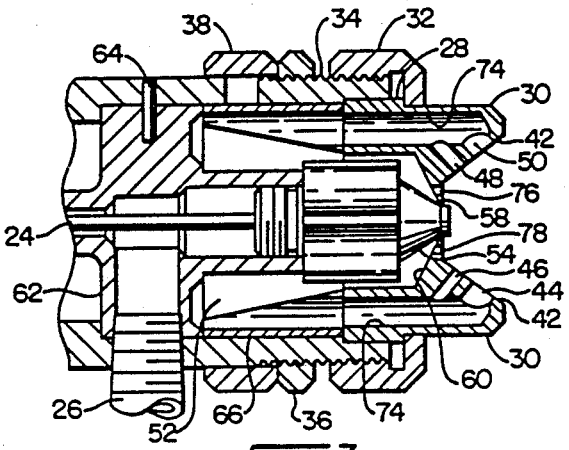
FIG. 3 is a cross sectional view taken along line 3—3 of the nozzle of FIG. 2.

A cross section of the spray nozzle assembly is shown in FIG. 3. In this view atomizing air chamber 52 is shown with fluid nozzle valve 54 penetrating it, atomizing air chamber 52 having a central aperture 58 located at its outlet end. It will be noted that the central aperture 58 has a converging frusto-conical shaped surface 60. Preferably the frusto-conical shaped surface 60 has a slope not corresponding to the converging conical end of fluid nozzle valve 54, that is, the angle subtended by the cone shaped surface 54 is less than the angle formed by surface 60. The reason is to have better control of the flow pattern.

Figure 4:
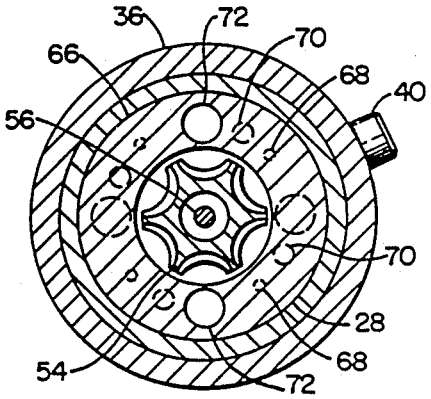
FIG. 4 is a cross sectional view taken along line 4—4 of the nozzle of FIG. 1.
Figure 5:
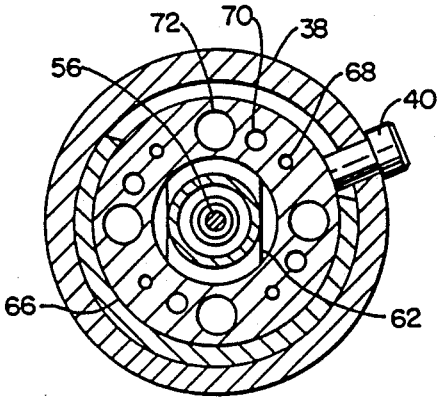
FIG. 5 is a cross sectional view taken along line 5—5 of the nozzle of FIG. 1.

As best seen in FIGS. 3 and 4 a paint feed assembly 62 is mounted in body 10 by a pin 64. As best seen in FIG. 5, air moves from the handle into chamber 52 by flowing around the sides of feed assembly 62. Mounted between nozzle 28 and assembly 62 is a rotable ring 66 for adjusting the flow of air to the spray pattern adjusting orifices 44, 46, 48, 50. As best seen in FIGS. 4 and 5, rotable ring 66 includes four sets of channels. Each set includes a small 68, medium 70 and large 72 channel. Adjusting lever 40 moves air adjusting ring 38 to align one of the channels (or none of the channels) with each of a pair of ducts 74 according to the desires of the operator. Thereby the operator may adjust the volume of air to orifices 44, 46, 48 and 50 to control the degree of flattening of the circular spray into an oval pattern. The reason for four patterns or sets of channels 68, 70 and 72 is to allow easy alignment regardless of whether the ears 30 are aligned vertically or horizontally.

Note in FIG. 4 the fluted outer surface of fluid nozzle valve 54. The scalloped appearance increases in cross-sectional area as the air approaches the aperture or outlet 58. The fluted surface and increasing cross-sectional area combine to provide the desired laminar air flow through the outlet 58, thereby the paint droplets are more uniformly dispersed in the air stream.

The pattern adjusting air enters chamber 52 and proceeds through a channel 68, 70 or 72 and ducts 74 out to pattern adjusting orifices 44, 46, 48, 50 provided pattern adjusting ring 46 allows passage, the pattern adjusting air stream then impinges the atomized air stream emanating from aperture 58 in the face 42 of the spray nozzle assembly. Pattern adjusting air acts to compress the usually circular pattern shape of the atomized fluid and air mixture into an oval, or flat pattern. Conventionally two streams of pattern adjusting air are provided from pattern adjusting nozzles which are located 180° apart on the face of the nozzle. The action of the two together is to squeeze the circular pattern into the above described oval. The function of the pattern adjusting plate is to allow for utilization of one or the other of the normally two available pattern adjusting nozzles thereby allowing either one or two or none of the pattern adjusting nozzles to impinge its pattern adjusting air against the atomzied fluid and air stream of the central circular spray. If two adjusting air nozzles are in operation the result is as conventionally described above, however if only one of the nozzles is utilized the result is an off center oval spray that looks more like a fan pattern in cross section either to the right or to the left, or up and down depending upon the orientation of the nozzle ears. The pattern adjusting ring is a movable plate allowing adjustment between a circular pattern (with no pattern adjusting nozzles in operation), a right, left/up, down open oval spray; or a traditional flat or long oval pattern.

Note also that two orifices 76 and 78 are coplaner with aperture 58. Their function is to discharge air when the spray gun is operating to minimize paint build up on the face of the nozzle.

Turning now to FIG. 5 which shows in cross section the portion of the nozzle of the present invention occupied by the pattern adjusting ring 66 as located within body 10. Looking also to FIG. 4 which is a cross section taken immediately adjacent the ring shape pattern adjusting plate showing the entrance to ducts 74 at the end of pattern adjusting air chamber 52. In viewing both FIGS. 4 and 5 together, when the pattern adjusting ring channel 68 is aligned with duct 74 on one side and the diagonally opposite channel 68 is also aligned with the corresponding duct 74. By utilizing spray pattern adjusting lever 40 all pattern adjusting channels may be aligned with one of the ducts 74. However it will be noted that ring 66 may be rotated to a position aligning none of the channels with duct 74.

It will be apparent from the above description that this invention provides an apparatus of adjusting the spray pattern during the continuous operation of the spray nozzle by the simple movement of the spray pattern adjusting lever so as to align the channels of the pattern adjusting plate with the ducts leading to the pattern adjusting orifices. The various combinations of pattern adjusting ring channels and operational pattern adjusting nozzles creates different spray patterns which may be utilized in different areas of a process such as spray painting.

Figure 6:
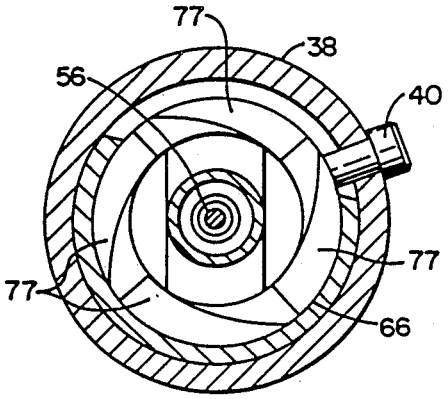
FIG. 6 is an elevational view of an alternative form of pattern adjusting ring for the nozzle.

An alternative embodiment of the pattern adjusting ring 66 is illustrated in FIG. 6. The difference is that the raised surfaces 77 are curved and continuous. Thereby there is an infinite range of flow rates through duct 74 from maximum to zero.

Having thus described this invention in its preferred embodiment, it will be clear that modifications may be made to the structure without departing from the spirit of the invention. Accordingly, it is not intended that the drawings nor the words used to describe the same be limiting on the invention. Rather, it is intended that the invention be limited only by the scope of the appended claims.

I claim:

1. A spray nozzle for use with air atomizable liquids comprising;

means forming an air chamber having an outlet end;

a reciprocably mounted fluid nozzle valve having a conical taper penetrating said air chamber and extending to and coaxially aligned with a central circular aperture in the outlet end of said air chamber;

means for delivering a liquid to said central aperture for atomization by air exiting said air chamber through said central aperture;

at least two pattern adjusting nozzles disposed adjacent to the central aperture of said air chamber;

means for adjusting fluid communication to said pattern adjusting nozzles to vary the flow rate of air through said nozzles; and means for providing laminar air flow through the central aperture, the outlet end of said air chamber having a converging down stream frusto-conical shape which terminates at said central aperture, said fluid nozzle valve including fluted surface means of increasing down stream cross-sectional area for air flow for providing said laminar air flow through the central aperture.

2. The nozzle according to claim 1 wherein each pattern adjusting nozzle is located in a nozzle ear which projects beyond the plane of said central aperture.

3. The nozzle according to claim 2 wherein said pattern adjusting means includes a rotable ring having channels of varying cross-sectional area which may be movably aligned with said pattern adjusting nozzles.

4. The nozzle according to claim 2 wherein two pattern adjusting nozzles are located on diagonally opposite sides of said central aperture.

5. The nozzle according to claim 1 wherein said pattern adjusting means includes a rotable ring having a plurality of raised surfaces configured to block air ducts leading from said air chamber to the pattern adjusting nozzles, said raised surfaces being sloped to provide a continuously changing air flow rate based on the rotational position of the ring.

6. The nozzle according to claim 1 wherein said pattern adjusting means includes a rotable ring having channels of varying cross-sectional area which may be movably aligned with said pattern adjusting nozzles.

7. The nozzle according to claim 2 wherein said pattern adjusting means includes a rotable ring having a plurality of raised surfaces configured to block air ducts leading from said air chamber to the pattern adjusting nozzles, said raised surfaces being sloped to provide a continuously changing air flow rate based on the rotational position of the ring.

8. The nozzle according to claim 1 including means for preventing paint build up on the nozzle around the central aperture.

9. The nozzle according to claim 3 including means for preventing paint build up on the nozzle around the central aperture.

10. The nozzle according to claim 8 wherein the means for preventing paint build-up comprises at least one orifice in fluid communication with said air chamber, said orifice being radially outward of and co-planer with said aperture.

11. The nozzle according to claim 9 wherein the means for preventing paint build-up comprises at least one orifice in fluid communication with said air chamber, said orifice being radially outward of and co-planer with said aperture.

* * * * *